United States Patent [19]

Pajgrt et al.

[11] Patent Number: 5,009,253

[45] Date of Patent: Apr. 23, 1991

[54] DEVICE FOR REMOVING A THREAD, WITH ROTATABLE RING AND ROTATABLE BOOM FOR CLAMPING AN END OF THE THREAD

[75] Inventors: Jan Pajgrt, Brno; Vincenc Smetak, Lelekovice; Jaroslav Kalina; Michal Zemek, both of Brno; Milan Pus, Uhersky Brod; Pavel Bucek, Brno, all of Czechoslovakia

[73] Assignee: ZVS Vyzkumnevyvojovy ustav, Czechoslovakia

[21] Appl. No.: 346,398

[22] Filed: May 2, 1989

[30] Foreign Application Priority Data

May 3, 1988 [CS] Czechoslovakia ..... 2966-88
May 24, 1988 [CS] Czechoslovakia ..... 3510-88

[51] Int. Cl.[5] ..... D03D 47/30
[52] U.S. Cl. ..... 139/116.2; 139/194
[58] Field of Search ..... 139/116.2, 429, 435, 139/194; 242/47.01

[56] References Cited

U.S. PATENT DOCUMENTS 4,664,157 5/1987 Shin ..... 139/116 A
4,688,606 8/1987 Tamatani ..... 139/116 A

FOREIGN PATENT DOCUMENTS 0200168 12/1986 European Pat. Off. .
0236597 9/1987 European Pat. Off. .

*Primary Examiner*—Andrew M. Falik
*Attorney, Agent, or Firm*—Ostrolenk, Faber, Gerb & Soffen

[57] ABSTRACT

A device for removing a thread includes a rotatable ring and a rotatable boom. THe rotatable boom is displaceable toward the rotatable ring to clamp an end of the thread between the inner surface of the rotatable ring and the outer surface of the rotatable boom. The device also includes a driver for (1) displacing the rotatable boom toward the rotatable ring to clamp the end of the thread between the inner surface of the rotatable ring and the outer surface of the rotatable boom and (2) rotating the rotatable boom while the end of the thread is clamped between the inner surface of the rotatable ring and the outer surface of the rotatable boom.

11 Claims, 3 Drawing Sheets

DEVICE FOR REMOVING A THREAD, WITH ROTATABLE RING AND ROTATABLE BOOM FOR CLAMPING AN END OF THE THREAD

BACKGROUND OF THE INVENTION

1. Field of the Invention

The invention relates to a device for removing a thread. The invention also relates to a weaving machine.

2. Description of the Related Art

A jet weaving machine which includes a device for removing an improperly picked weft thread is known. The device is mounted at the inlet side of the shed between the machine's main inserting nozzle and profiled reed, outside the weft path. The device consists of a winding unit formed of winding and rotary members coaxially mounted in a tubular case. The winding member is rotatably mounted and slides axially on a bar within a sliding bearing. The rotary member is rotatably mounted in ball bearings and is driven through gears by a motor.

A free end of the winding member is provided with a circumferential conical winding surface. The rotary member has a conical recess and a rotary shaft The shape of the conical winding surface of the winding member corresponds to the shape of the conical recess of the rotary member.

The conical recess of the rotary member communicates with an ejecting channel within the rotary member's shaft. The ejecting channel opens into a waste box. A nozzle is centrally located within the winding member and is directed toward the ejecting channel. The nozzle is connected to a bushing for distributing pressurized fluid.

The winding and rotary members face each other within the tubular case. A suitable gap separates the winding and rotary members. The winding and rotary members are both axially aligned with the longitudinal axis of the weft inserting nozzle. A guiding tube is mounted transversely to the case. The guiding tube opens into the case at a position corresponding to the gap between the winding and rotary members. A guiding nozzle is mounted against the orifice of the guiding tube outside the weft path such that the weft path is situated therebetween.

To withdraw an improperly picked weft from the shed, weft is fed from the inserting nozzle and blown by the guiding nozzle into the guiding tube and, by means of the nozzle in the winding member, into the ejecting channel of the rotary member. Thereafter, weft feeding from the inserting nozzle is stopped and an auxiliary cutter (situated between the nozzle and the guiding tube) separates the weft. The winding member is then displaced toward the rotary member until the conical surfaces contact each other. The motor then begins to rotate the rotary member through the gearing such that the rotary member rotates the winding member (which is in contact therewith). As a result, the improperly picked weft is wound onto the conical surface of the winding member and is withdrawn from the shed back toward the main nozzle in a single length.

After the improperly picked weft is wound onto the conical surface of the winding member, the fuzz ball thus created is blown by the nozzle of the winding member through the ejecting channel and into the waste box.

The above-described device for removing an improperly picked weft is disadvantageous because of its positioning at the inlet to the shed. To weave under constant conditions, the device must be positioned outside the weft path, thus complicating the drawing-in of the thread into the winding unit.

Moreover, the thread is drawn back directly in a single length without first being released from the interlacing point of the fabric. Thus, particularly with delicate yarns, there exists the danger of surpassing the limiting stress of the thread, causing the weft to break before being completely withdrawn. This danger is enhanced because the weft rubs excessively against an edge of the guiding tube as it changes direction through the guide tube while being withdrawn.

Moreover, the rigid mechanical gearing of the winding unit cannot compensate for increased tensile stress in the weft caused, e.g., when the thread is locally trapped. This also causes the improperly picked weft to break. Thus, the means for driving the rotary member increases the exacting character of the prior art design.

Moreover, the position of the ejecting nozzle within the winding member is inefficient because pressurized fluid acts initially only upon the free end of the improperly picked weft. This can cause the winds of the fuzz ball to tighten on the conical surface of the winding member such that the wound up weft fuzz ball cannot be transported into the waste box.

SUMMARY OF THE INVENTION

The invention is directed to a device for removing a thread, including: (A) a rotatable ring with an inner surface; (B) a rotatable boom with an outer surface, the rotatable boom being displaceable toward the rotatable ring to clamp an end of the thread between the inner surface of the rotatable ring and the outer surface of the rotatable boom; and (C) driving means for (1) displacing the rotatable boom toward the rotatable ring to clamp the end of the thread between the inner surface of the rotatable ring and the outer surface of the rotatable boom and (2) rotating the rotatable boom while the end of the thread is clamped between the inner surface of the rotatable ring and the outer surface of the rotatable boom, the driving means being directly operatively connected to the rotatable boom.

Preferably, the thread is an improperly picked weft thread. Preferably, the inner surface of the ring is an inner conical surface, the outer surface of the boom being an outer conical surface Preferably, the ring, the boom, and the driving means are coaxial with each other, the boom being axially displaceable toward the ring. Preferably, the driving means includes displacing means for axially displacing the boom and a pneumatically reactive driving unit for rotating the boom, the displacing means and the reactive driving unit being adapted to be driven by a common source of pressurized air. Preferably, the displacing means includes a stationary piston and a cylinder partially surrounding the piston, the cylinder being connected to the boom so as to be axially displaceable and rotatable with the boom. Preferably, the reactive driving unit includes a hollow arm which extends in a radial direction with respect to the axis of the driving means, the arm having an outlet hole which is directed transversely with respect to the radial direction, the reactive driving unit being adapted to direct air through the arm and the hole to rotate the boom. Preferably, the reactive driving unit includes a centrifugal governor for controlling the angular velocity of the boom. Preferably, the arm includes a limiting nozzle directed oppositely with respect to the outlet hole, the reactive driving unit including a control weight slidably located on the arm, the control weight being adapted to selectively cover the outlet hole to control the angular velocity of the boom.

Preferably, the device further includes a stationary nozzle for (1) directing pressurized air through the ring to draw the end of the thread into position to be clamped between the boom and the ring and (2) directing pressurized air across the outer conical surface of the boom to blow the thread from the boom and through the ring. Preferably, the ring includes a second conical surface, the conical surfaces of the ring forming a diffuser which is adapted to cooperate with the nozzle to draw the end of the thread into position to be clamped between the boom and the ring. Preferably, the nozzle is located in the vicinity of the conical surface of the boom and is inclined with respect to the axis of the boom.

Preferably, the device further includes a magnet for urging the ring toward the conical surface of the boom. Preferably, the device further includes an opening for cooperation with the ring, the ring being movable into and out of engagement with the opening, the magnet being adapted to urge the ring into engagement with the opening. Preferably, the magnet is stationary with respect to the opening, the ring including a central portion which extends within the magnet and a radially extending contact surface located underneath the magnet.

The invention is also directed to a weaving machine, including: (A) an inlet side of a shed, an outlet side of the shed, and inserting means for inserting weft threads through the shed along a weft path, the inserting means being located at the inlet side; and (B) a device for removing an improperly picked weft thread from the shed, the device being located at the outlet side, the device including: (1) a rotatable ring with an inner surface; (2) a rotatable boom with an outer surface, the rotatable boom being displaceable toward the rotatable ring to clamp an end of the improperly picked weft thread between the inner surface of the rotatable ring and the outer surface of the rotatable boom; and (3) driving means for (a) displacing the rotatable boom toward the rotatable ring to clamp the end of the improperly picked weft thread between the inner surface of the rotatable ring and the outer surface of the rotatable boom and (b) rotating the rotatable boom while the end of the improperly picked weft thread is clamped between the inner surface of the rotatable ring and the outer surface of the rotatable boom.

Preferably, the driving means is directly operatively connected to the rotatable boom. Preferably, the device is located in the weft path. Preferably, the machine is a jet weaving machine, the inserting means including an inserting nozzle.

The preferred embodiment is advantageous because of its simple design and its ability to operate without an external mechanical drive. To evenly withdraw the weft, the device provides a constant angular velocity and a torque which can be readily adjusted by air pressure control. A further advantage of the device is the positioning of the blow off nozzle, whereby reliable removal of the weft fuzz ball is obtained.

Other features and advantages of the invention will become apparent from the following description of a preferred embodiment of the invention, with reference to the accompanying drawings

DETAILED DESCRIPTION OF THE PREFERRED EMBODIMENT

Figure 1:
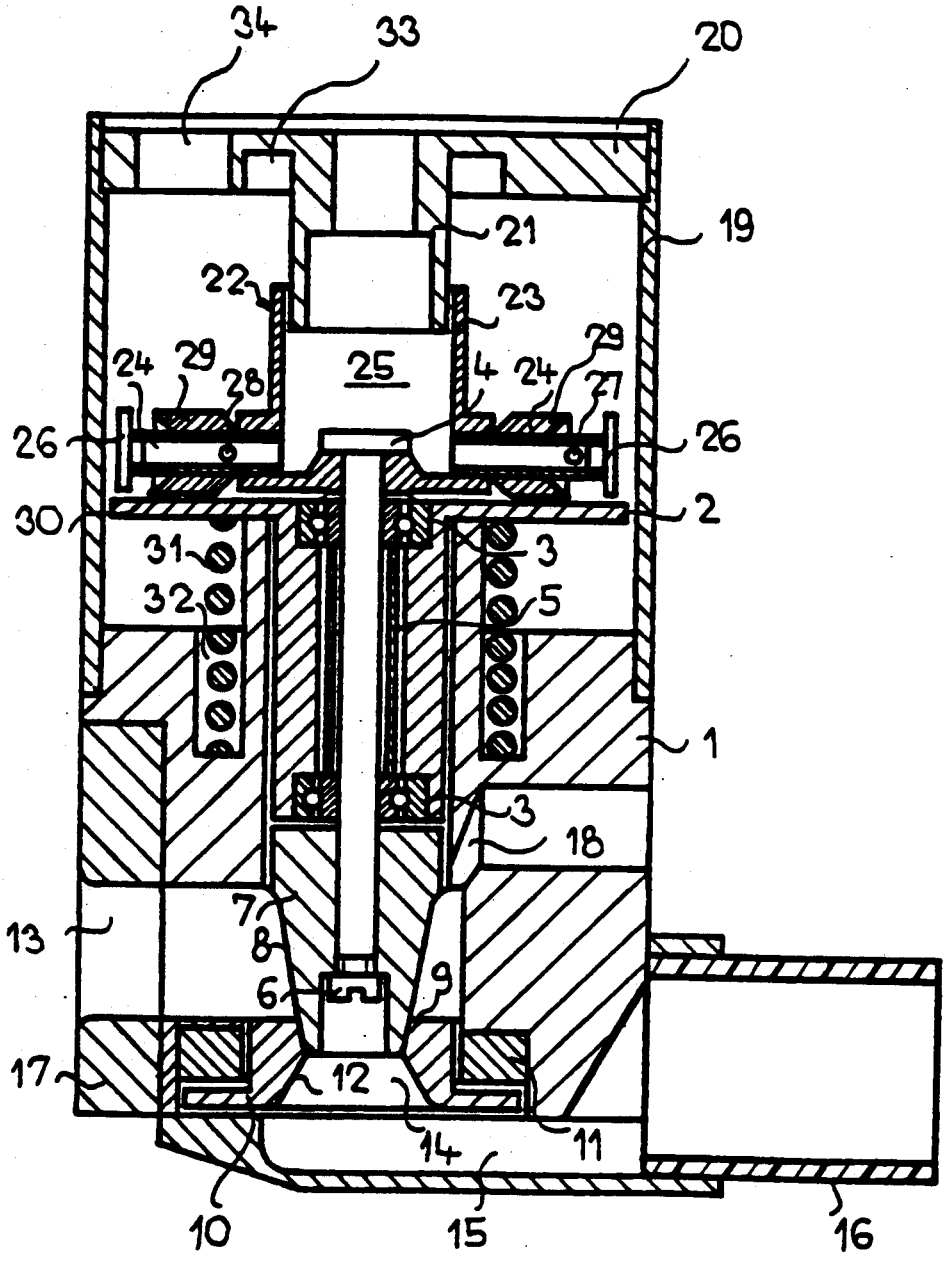
FIG. 1 is a cross-sectional view of the preferred embodiment of the invention.
Figure 2:
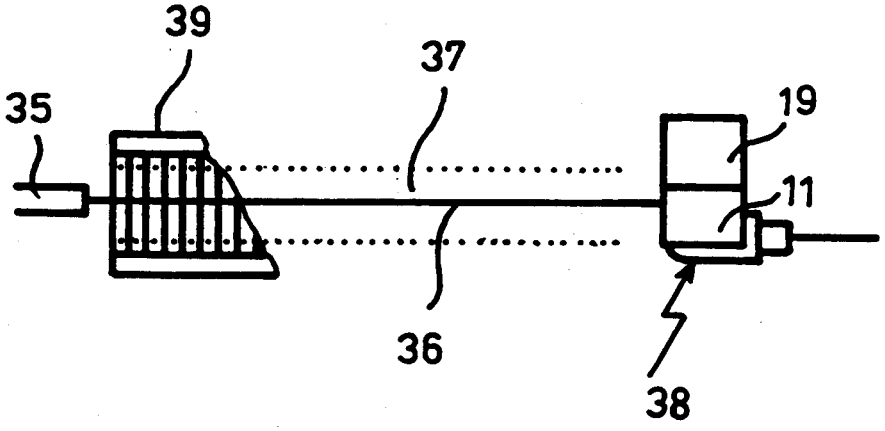
FIG. 2 schematically illustrates the location of the preferred embodiment with respect to a weaving machine.
Figure 3:
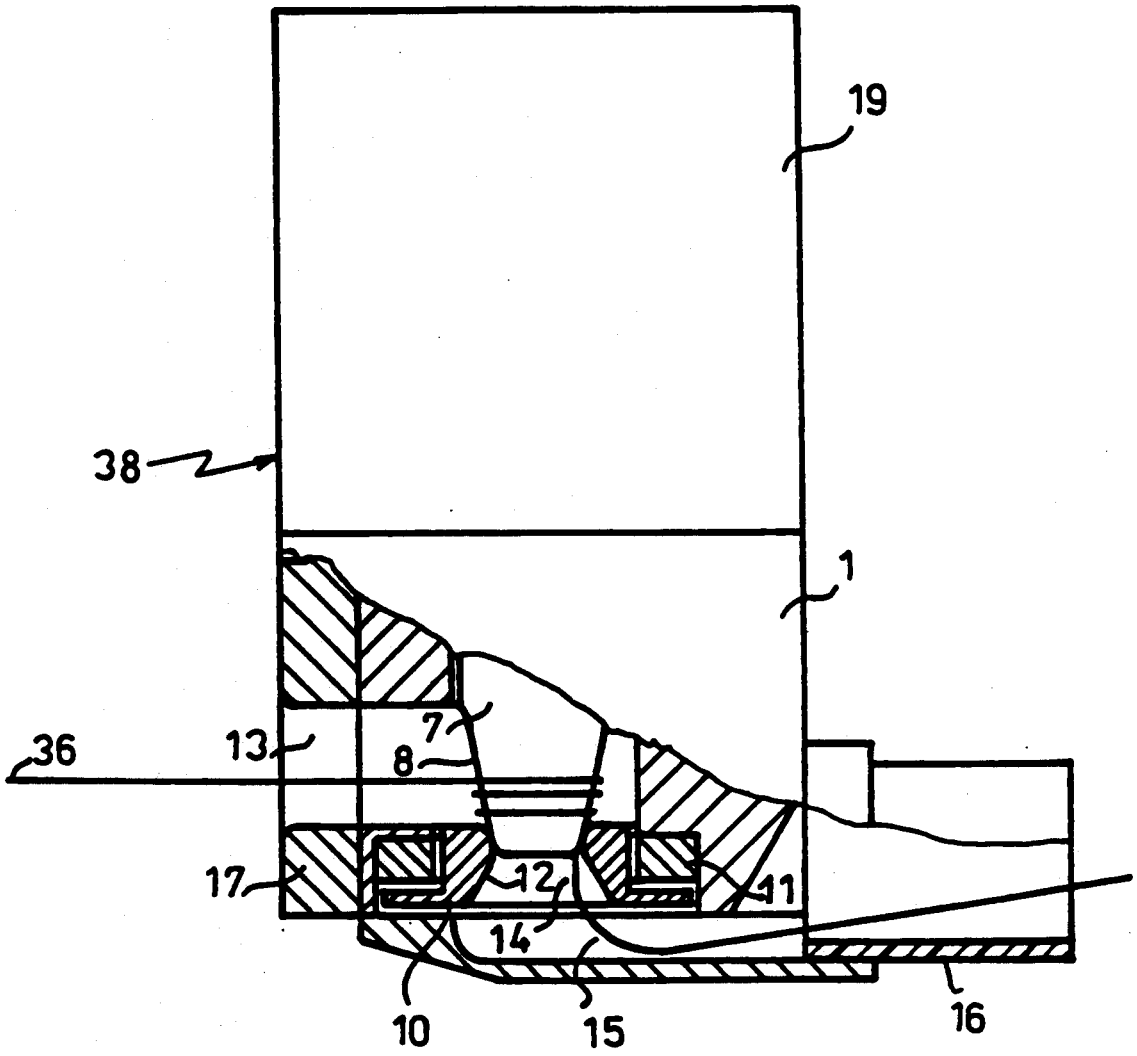
FIG. 3 is a cut away view of the preferred embodiment, with a thread.

A device 38 in accordance with the preferred embodiment of the invention is mounted in the weft path on the end side of a weaving machine shed 37. The device 38 is fastened outside of the range of operation of a beat-up reed 39.

The device 38 includes a body 1 and a hub 2 which is slidably mounted within the body 1. A shaft 4 is rotatably mounted in a cylindrical interior of the hub 2 by a pair of radial bearings 3. The bearings 3 are braced inside the hub 2 by a tubular clearance filler 5.

In a lower part of the device 38, a boom 7 is fastened to the shaft 4 by a screw 6. The boom 7 has an outer conical surface 8. The boom 7 is displaceable into engagement with an inner conical surface 9 of a contact ring 10 which is mounted in the body 1. The contact ring 10 is biased toward the body 1 by a magnet 11. Another conical surface 12 of opposite conicity cooperates with the inner conical surface 9 of the ring 10 and forms a diffuser therein. A free part of the outer conical surface 8 engages the inner conical surface 9 in a weft inlet hole 13. The inner conical surface 9 forms, together with the conical surface 12, an opening 14 through the ring 10 and a suction chamber 15 in the bottom of the body 1. The suction chamber 15 is connected to a suction mechanism (not illustrated) by a hose 16. A sensor 17 is located at the orifice of the inlet hole 13. The sensor 17 records the presence of the improperly picked weft 36. A pneumatic nozzle 18 communicates with the inlet hole 13 through an inclined opening. The opening of the nozzle 18 is directed toward the opening 14.

An upper part of the hub 2 extends as far as the inner circumference of a cylindrical shell 19 which is fastened to the body 1. The shell 19 is covered by a cover 20. In the central part of the cover 20, a hollow projection is drawn into the device 38 to form a stationary piston 21 of an air damper 22 for displacing the rotatable boom 7. A cylinder 23 of the damper 22 is loosely positioned on the piston 21 and fastened to the shaft 4 of the boom 7. Four hollow arms 24 of a reactive driving unit 25 project radially from a lower part of the cylinder 23. Each arm 24 has a blindage 26 located at its end. Each blindage 26 extends beyond the outer circumference of each respective arm 24.

Each arm 24 has a transversal outlet hole 27 in the vicinity of its blindage 26. The outlet holes 27 form nozzles for rotating the driving unit 25. The outlet holes 27 are commonly situated so as to cooperate to rotate the unit 25 in a winding direction. Each arm 24 also has an opposite direction limiting nozzle 28 which opens into the hollow of the arm 24. The nozzles 28 are directed oppositely relative to the outlet holes 27. A control weight 29 is displaceably mounted on each of the arms 24. The control weights 29 form a centrifugal governor 30 for controlling the angular velocity of the driving unit 25. The faces of each control weight 29 are beveled. Bevels toward the sides of the blindages 26 are internal and, from the side of the cylinder 23, external.

At rest, the rotatable boom 7 is inserted into the hollow of the body 1 by a coil spring 31 mounted in a circular groove 32. One end of the spring 31 is supported against the bottom of the circular groove 32 and the other end is supported against an enlarged part of the hub 2. In the rest position, the upper end of the cylinder 23 is situated in a circular groove 33 in the cover 20. An opening 34 is provided in the cover 20 to permit pressurized air to freely exit during operation of the driving unit 25. The damper 22, driving unit 25, and centrifugal governor 30 thus constitute the device's driving mechanism.

The free end of the improperly picked weft 36 is first sucked into the device 38 by the pneumatic nozzle 18 and the diffuser (the opening 14). The weft 36 is sucked in through the inlet hole 13, through the opening 14, and into the suction chamber 15. Thereafter, pressurized air is introduced through the piston 21 and into the cylinder 23. The pressurized air overcomes the resistance of the coil spring 31 and displaces the rotatable boom 7 into the inlet hole 13. Thus, the outer conical surface 8 of the rotatable boom 7 comes into contact with the inner conical surface 9 of the ring 10 such that the end of the weft 36 is stationarily clamped therebetween.

Displacing the rotatable boom 7 into engagement with the contact ring 10 causes the contact ring 10 to be removed from the permanent magnet 11. Simultaneously, as the compressed air begins to flow out through the transversal outlet holes 27 of the arms 24, the reactive driving unit 25 begins to rotate the boom 7. The driving unit 25 rotates the rotatable boom 7 at a constant angular velocity. That is, as the rotational speed of the boom increases, the control weights 29 of the centrifugal governor 30 are displaced radially outwardly by centrifugal force, thus closing the outlet holes 27. Simultaneously with the displacement of the control weights 29, the oppositely directed limiting nozzles 28 reduce the angular velocity of the boom 7. As the velocity decreases, the pressurized air acts on the inner bevels of the control weights 29 to overcome their centrifugal force and to displace the control weights 29 inwardly. Thus, an equilibrium state is obtained. In this manner, the weft 36 is wound onto the rotatable boom 7 at an absolutely uniform, guaranteed angular velocity without impacts. If necessary, the torque of the rotatable boom 7 can be easily adjusted by controlling the pressure of the air entering the driving unit 25. The torque is independent of the angular velocity of the rotatable boom 7.

While winding the improperly picked weft 36, the contact ring 10 is removed from the magnet 11 and rotates in its magnetic field with the boom 7 without any undesirable friction Yet the weft 36 remains clamped between the conical surfaces 8 and 9 by the constant force of the magnetic field. After winding is completed, introduction of pressurized air into the cylinder 23 is stopped and the coil spring 31 returns the rotatable boom 7, together with the driving unit 25, to the rest position. When the boom 7 returns to the rest position, the ring 10 again bears against the magnet 11 such that the outer conical surface 8 and the inner conical surface 9 no longer engage each other.

The fuzz ball is then removed by introducing pressurized air into the pneumatic nozzle 18 such that the air flows over the outer conical surface 8 of the rotatable boom 7 and through the opening 14 of the ring 10. The weft 36 is sucked into the suction chamber 15 and exits the device through the hose 16.

The magnet 11, which retains both the ring 10 in the body 1 of the device 38 and clamps the ring 10 to the boom 7 while permitting free rotation therewith, can be either a permanent magnet or an electromagnet. The magnet 11 can be a continuous ring, or it may be formed of separate bodies distributed about the circumference of the body 1 in the vicinity of the opening 14.

The device specified above can be used in all types of weaving machines. Its position with respect to the weaving machine need not be only in the weft path.

Although the invention has been described in connection with a preferred embodiment thereof, many variations, modifications, and other uses will become apparent to those skilled in the art. It is preferred, therefore, that the invention be limited not by the specific disclosure herein, but only by the appended claims.

What is claimed is:

1. A device for removing a thread, said device comprising:

(A) a rotatable ring with an inner conical surface;

(B) a rotatable boom with an outer conical surface, said rotatable boom being axially displaceable toward said rotatable ring to clamp an end of the thread between said inner conical surface of said rotatable ring and said outer conical surface of said rotatable boom; and (C) driving means for (1) displacing said rotatable boom toward said rotatable ring to clamp the end of the thread between said inner conical surface of said rotatable ring and said outer conical surface of said rotatable boom and (2) rotating said rotatable boom while the end of the thread is clamped between said inner conical surface of said rotatable ring and said outer conical surface of said rotatable boom;

wherein said driving means is directly operatively connected to said rotatable boom;

wherein said ring, said boom and said driving means are coaxial with each other;

wherein said driving means includes (1) displacing means for axially displacing said boom and (2) a pneumatically reactive driving unit operable for rotating said boom, said displacing means and said reactive driving unit having means permitting them to be driven by a common source of pressurized air.

2. The device of claim 1, wherein said displacing means includes an air damper, said air damper including a stationary piston and a cylinder partially surrounding said piston, said cylinder being connected to said boom so as to be axially displaceable and rotatable with said boom.

3. The device of claim 1, wherein said reactive driving unit includes a centrifugal governor for controlling the angular velocity of said boom.

4. The device of claim 1, wherein said reactive driving unit includes a hollow arm which extends in a radial direction with respect to the axis of said driving means, said arm having an outlet hole which is directed transversely with respect to said radial direction, said respective driving unit having means for directing air through said arm and said hole to rotate said boom.

5. The device of claim 4, wherein said arm includes a limiting nozzle directed oppositely with respect to said outlet hole, said reactive driving unit including a control weight slidably located on said arm, said control weight having means to selectively cover said outlet hole to control the angular velocity of said boom.

6. A device for removing a thread, said device comprising:

(A) a rotatable ring with an inner conical surface;

(B) a rotatable boom with an outer conical surface, said rotatable boom being displaceable toward said rotatable ring to clamp an end of the thread between said inner conical surface of said rotatable ring and said outer conical surface of said rotatable boom;

(C) driving means for (1) displacing said rotatable boom toward said rotatable ring to clamp the end of the thread between said inner conical surface of said rotatable ring and said outer conical surface of said rotatable boom and (2) rotating said rotatable boom while the end of the thread is clamped between said inner conical surface of said rotatable ring and said outer conical surface of said rotatable boom, said driving means being directly operatively connected to said rotatable boom; and (D) a stationary nozzle which (1) directs pressurized air through said ring to draw the end of the thread into position to be clamped between said boom and said ring and (2) directs pressurized air across said outer conical surface of said boom to blow the thread from said boom and through said ring.

7. The device of claim 6, wherein said ring includes a second conical surface, said conical surfaces of said ring forming a diffuser which cooperates with said nozzle to draw the end of the thread into position to be clamped between said boom and said ring.

8. The device of claim 6, wherein said nozzle is located in the vicinity of said conical surface of said boom and is inclined with respect to the axis of said boom.

9. A device for removing a thread, said device comprising:

(A) a rotatable ring with an inner conical surface;

(B) a rotatable boom with an outer conical surface, said rotatable boom being displaceable toward said rotatable ring to clamp an end of the thread between said inner conical surface of said rotatable ring and said outer conical surface of said rotatable boom;

(C) driving means for (1) displacing said rotatable boom toward said rotatable ring to clamp the end of the thread between said inner conical surface of said rotatable ring and said outer conical surface of said rotatable boom and (2) rotating said rotatable boom while the end of the thread is clamped between said inner conical surface of said rotatable ring and said outer conical surface of said rotatable boom, said driving means being directing operatively connected to said rotatable boom; and (D) a magnet which urges said ring toward said outer conical surface of said boom.

10. The device of claim 9, further comprising an opening which cooperates with said ring, said ring being movable into and out of engagement with said opening, said magnet urging said ring into engagement with said opening.

11. The device of claim 10, wherein said magnet is stationary with respect to said opening, said ring including a central portion which extends within said magnet and a radially extending contact surface located underneath said magnet.

* * * * *